US007748368B2

(12) United States Patent
Forti

(10) Patent No.: US 7,748,368 B2
(45) Date of Patent: Jul. 6, 2010

(54) LAUNCHER FOR FLYING CYLINDERS

(75) Inventor: William Mark Forti, Claremont, CA (US)

(73) Assignee: William Mark Corporation, Claremont, CA (US)

( * ) Notice: Subject to any disclaimer, the term of this patent is extended or adjusted under 35 U.S.C. 154(b) by 603 days.

(21) Appl. No.: 11/499,428

(22) Filed: Aug. 4, 2006

(65) Prior Publication Data

US 2007/0039600 A1 Feb. 22, 2007

Related U.S. Application Data

(60) Provisional application No. 60/709,504, filed on Aug. 18, 2005.

(51) Int. Cl.
*F41B 7/00* (2006.01)

(52) U.S. Cl. ..... 124/17; 124/81

(58) Field of Classification Search ..... 124/16, 124/17, 21, 81

See application file for complete search history.

(56) References Cited

U.S. PATENT DOCUMENTS

| | | | | |
|---|---|---|---|---|
| 931,221 | A * | 8/1909 | Rogers | 473/511 |
| 5,816,880 | A | 10/1998 | Forti et al. | |
| 5,970,970 | A | 10/1999 | Vanek et al. | |
| 6,048,245 | A | 4/2000 | Forti et al. | |
| 6,079,398 | A | 6/2000 | Grimm | |
| 6,599,161 | B2 * | 7/2003 | Hunter | 446/39 |
| 6,679,748 | B2 | 1/2004 | Forti et al. | |
| 6,742,509 | B2 * | 6/2004 | Hunter et al. | 124/17 |
| D522,070 | S * | 5/2006 | Hunter et al. | D21/570 |
| 7,037,164 | B2 * | 5/2006 | Silverglate | 446/63 |
| 2007/0006861 | A1 * | 1/2007 | Sapir | 124/17 |

* cited by examiner

*Primary Examiner*—John Ricci
(74) *Attorney, Agent, or Firm*—Fish & Associates, PC

(57) ABSTRACT

A launcher for a flying cylinder has a elongated guide member to which a base is slidably coupled. In preferred aspects, a pair of resilient elements is coupled at respective first portions to one end of the guide member while respective second portions are coupled to the base. Most preferably, coupling is performed via cutouts in the guide element and the base to permit simple replacement of the resilient elements.

15 Claims, 2 Drawing Sheets

LAUNCHER FOR FLYING CYLINDERS

This application claims priority to our copending U.S. provisional patent application with the Ser. No. 60/709,504, which was filed Aug. 18, 2005.

FIELD OF THE INVENTION

Handheld launchers for flying toys, and especially for flying cylinders.

BACKGROUND OF THE INVENTION

Flying cylinders are well known in the art and some examples for such toys are provided in U.S. Pat. Nos. 6,679,748, 6,048,245, and 5,816,880. While these toys can have remarkable trajectories when thrown by hand, at least some dexterity and physical strength is required to achieve consistent long-distance flight. Therefore, various mechanical launchers have been proposed in the art, and exemplary launchers are disclosed in U.S. Pat. Nos. 6,742,509, 6,079,398, 5,970,970, and 6,559,161. While such launchers often propel the flying toy with some force, various disadvantages remain. Among other things, heretofore known toys are often expensive, or require a particular brand of flying rings. Furthermore, currently known launchers are often mechanically complex and tend to fail frequently.

Therefore, while numerous toy launchers for flying cylinders are known in the art, all or almost all of them suffer from one or more disadvantages. Consequently, there is still a need to provide improved devices and methods to launch flying cylinders.

SUMMARY OF THE INVENTION

The present invention is directed to devices and methods of launching a flying cylinder using a hand-held launcher that includes resilient elements to provide forward and optionally rotational momentum. Most preferably, the resilient elements are coupled to the launcher in a manner that allows replacement by even the most inexperienced user, and the resilient elements are commercially available rubber bands to further simplify replacement and reduce cost.

In one aspect of the inventive subject matter, a launcher for a flying cylinder includes an elongate guide element having a first end and a second end, and a base that is movably coupled to the guide element such that the base is movable along a longitudinal axis of the guide element, wherein the first end is configured to removably receive a first portion of a resilient element such that the first portion of the resilient element is retained by a wall of the guide element, wherein the base is configured to removably receive a second portion of the resilient element such that the second portion of the resilient element is retained by an indentation in the base, and wherein the base is further configured to at least partially surround the guide element and to support at least a portion of a flying cylinder. Most preferably, a stopper is coupled to the first end and configured such that the stopper stops movement of the base past the first end.

In especially preferred aspects, the launcher also includes a grip with a cylindrical portion that is coaxially and slidably coupled to the elongate guide element and further coupled to the base such that the base and the grip move together. Most typically, the grip and the base are configured to allow rotation of the base around the longitudinal axis when the grip is rotated. Additionally, it is preferred that the first end (which may be integral with the elongate guide element and/or stopper) has a cutout that receives and retains the first portion of the resilient element. In such case, a removable cap may be coupled to the first end such that the cap retains the first portion of the resilient element in the cutout. Where desirable, the first end is removable from the elongate guide element, and the second end is configured as a cylindrical handle. It is still further preferred that the resilient element is a circular rubber band, and that the launcher includes a second circular rubber band. In these and other configurations, the indentation is a cutout in the base (typically having a non-circular shape) configured to snugly receive the first portion of the resilient element.

Consequently, in another aspect of the inventive subject matter, a method of instructing a user of a launcher of a flying cylinder (in which the launcher has an elongate guide element with a first end and a second end, and further has a base movably coupled to the guide element such that the base is movable along a longitudinal axis of the guide element, wherein the base is further configured to at least partially surround the guide element and to support at least a portion of a flying cylinder) includes a step of instructing the user to insert a first portion of a resilient element into the first end such that the first portion of the resilient element is retained by a wall of the guide element. In a further step, the user is instructed to insert a second portion of the resilient element into the base such that the second portion of the resilient element is retained by an indentation in the base, and in a still further optional step, the user is instructed to couple a stopper to the first end and such that the stopper stops movement of the base past the first end.

In preferred methods, the resilient element is a rubber band, and further includes a step of instructing the user to insert the first portion into a cutout of the first end (optionally to couple a cap to the first end such that the cap retains the first portion of the resilient element in the cutout), and to insert the second portion of the resilient element into a cutout of the base. The user may further be instructed to couple a second resilient element to the first end and the base, and optionally to insert the elongate guide element through an opening in the base.

Various objects, features, aspects and advantages of the present invention will become more apparent from the following detailed description of preferred embodiments of the invention, along with the accompanying drawing.

DETAILED DESCRIPTION

The inventor has discovered that a launcher for a flying cylinder can be fabricated in a simple and effective manner, wherein preferred launchers provide both forward and rotational momentum to the cylinder as the cylinder is propelled by the launcher. Contemplated launchers also provide a simple mechanism that prevents the base from disengaging with the elongate guide element and further include an attachment mode of the resilient elements to the elongate guide element that allows for facile replacement of the resilient elements. In particularly preferred aspects, the resilient elements are commercially available rubber bands and can be readily installed by even the most inexperienced user.

Figure 1:
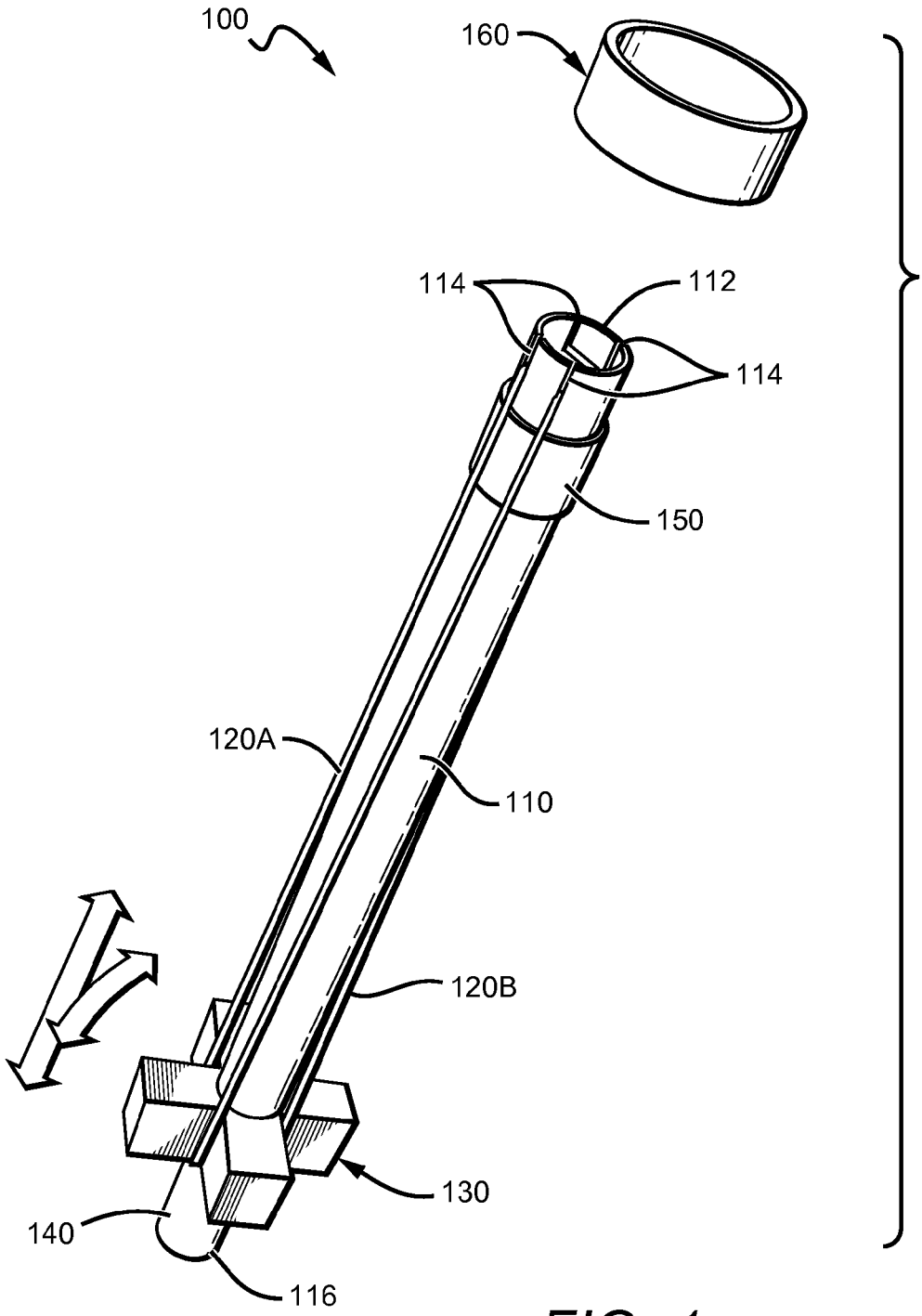
FIG. 1 is a schematic illustration of one exemplary launcher with the resilient elements in tensioned position.

One exemplary launcher is depicted in FIG. 1, in which launcher 100 has a cylindrical plastic tube 110 of about 3 feet in length and about ¾ inch in diameter as elongate guide element. The upper end 112 has four small cutouts 114 through which rubber bands 120A and 120B are threaded as resilient elements, respectively. The cutouts 114 in this device are dimensioned such that the rubber band 120A and 120B snugly engage with the tube 110 and are retained upon launching the cylinder (e.g., via a narrowing path of the cutout or via an opening at the end [not shown]). The base 130 is a cross-shaped hard foam element with which the other end of the rubber bands 120A and 120B engage (preferably via indentation, cutout, or other retaining mechanism). The base 130 includes a circular opening of sufficient size and with a configuration such that the base can move along the longitudinal axis of guide element 110 and that allows rotation of the base relative to the longitudinal axis of the guide element (arrows). Thus, when the base is retracted from the top end of the guide element towards the handle 140 (which is preferably contiguous with the guide element) at the bottom end 116, and when the handle is twisted while the user holds the base 130, the rubber bands are stretched and twisted to provide forward and rotational momentum to the flying cylinder 160 at the same time. A stopper 150 is further coupled to the guide element 110 and configured such that the stopper arrests the base to avoid ejection of the base from the guide element.

Figure 2:
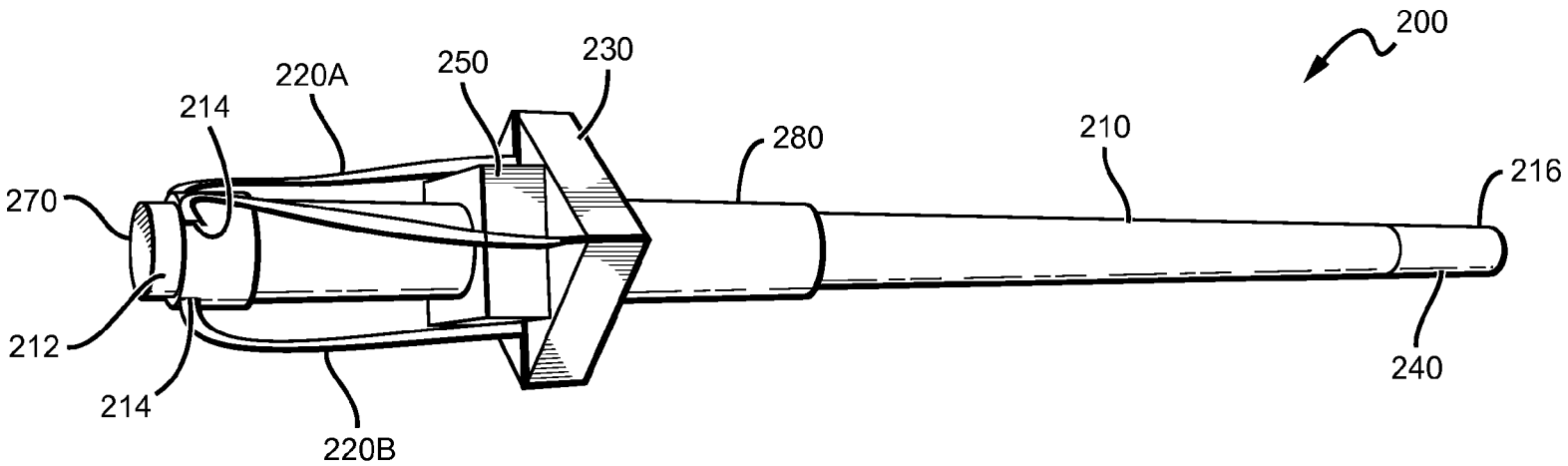
FIG. 2 is a photograph of another exemplary launcher with the resilient elements in relaxed position.

Another preferred exemplary launcher 200 is depicted in FIG. 2 in which the launcher is similarly configured and dimensioned as the launcher 100 in FIG. 1. However, the base 230 of the launcher of FIG. 2 is not cross shaped, but has a bottom platform for the cylinder to sit on. As above, the forward (and optionally rotational) momentum is used to launch the flying cylinder. Where desirable, rotational spin can be applied to provide a forward and/or rotational momentum to the toy. Also, in the launcher of FIG. 2, the stopper 250 is receded about 4 inches from the front of the elongated guide element 210. It should be noted that in this example the stopper 250 has a configuration effective (here: square) to keep the rubber bands separate. Furthermore, a cap 270 is attached to the front end 212 and assists in maintaining the rubber bands 220A and 220B within the cutouts 214 (only two of the four are labeled with 214). In especially preferred aspects, the launcher further includes a grip 280 that is coupled to the base 230 to facilitate pulling of the base 230 towards bottom end 216, which also includes handle 240. It should be noted that the flight distances for flying cylinders achieved with this launcher are from 100 to 200 feet (even larger distances are possible, but would not be as safe). A still further advantage of that launcher is that one can turn the launcher around and catch the cylinder in flight.

It should be recognized that the elongate guide element may have numerous alternative dimensions and shapes, and that all alternative sizes and shapes are deemed suitable for use herein. For example, the guide element may be curved, or have a horizontal cross section other than circular. Preferred materials for the elongate guide element include natural and synthetic polymers, which are most preferably shaped as hollow tubes having a wall thickness of 1/32" to ¼". In general, the length of contemplated guide elements will be between 15" to about 5 ft, and most typically between 2-4 feet. Furthermore, the diameter is preferably chosen such that the user can hold and command the guide element comfortably with one hand. Thus, preferred diameters will generally be in the range of between ½" to 2". Where desirable, the guide element may also include one or more grooves or other structures winding around the guide element to force a rotational motion upon the base if the base engages with the groove or other structure.

In further preferred aspects, the bottom portion of the elongate guide element will have a handle portion that is integral to the elongate guide element. Furthermore, it is preferred that the upper portion of the elongate guide element has a plurality of cutouts sized and dimensioned to accommodate a portion of the resilient elements. The cutouts may be straight, or narrowing to assist in retaining the resilient elements. Where desirable, the upper portion may also include the stopper as integral part of the elongate guide element or may have a thread or other mechanism to at least temporarily retain the stopper at the upper end. Thus, it should be appreciated that in preferred aspects of the inventive subject matter the resilient elements are directly coupled to the wall of the elongated guide element, which greatly simplifies replacement operation of the resilient elements. However, in alternative aspects, the upper portion may also include hooks, sleeves, or other retainers that allow temporary coupling of the resilient elements to the elongated guide element.

With respect to the base it is contemplated that the base may have numerous shapes other than a cross so long as the base provides at least some (direct or indirect) contact to the flying cylinder and can engage (directly or indirectly) with at least one resilient element. Preferably, the base and guide element are configured such that the base will not only have the capability to move along the longitudinal axis of the elongated guide element, but also have the capability to rotate relative to the guide element. Therefore, the base may include an opening through which the guide element is threaded and/or include rotational sleeves or other rotatable elements, especially where the guide element has not a circular horizontal cross section. It is still further especially preferred that the base includes a plurality of cutout, preferably sufficiently narrow to snugly engage with the resilient element to thereby retain at least temporarily the resilient element. Most typically, such cutout can be achieved in a foamed polymer by cutting into the polymer (see FIG. 2). Alternatively, the base may also include indentations configured other than a cutout, and all types of indentations, loops, hooks, and sleeves are deemed suitable for use herein.

In still further preferred aspects, the base is coupled to a grip to facilitate moving of the base. Thus, the grip will preferably include a cylindrical element that is slidably coupled to the elongated guide element, most preferably by sliding the grip over the elongated guide element. Alternatively, the grip may comprise an at least partially cylindrical portion that moves coaxially along the elongated guide element. Therefore, translational and/or rotational movement of the grip will move the base in the same manner. In less preferred embodiments, the grip may also be independent from (i.e., not guided by or coupled to) the elongated guide element. Preferred grips will be configured such that the user holds the grip with more than one or two fingers, however, in less preferred aspects, the grip may also include one or more loops that allow holding the grip with one or two fingers.

The handle in contemplated launchers is typically contiguous with the guide element, and may optionally include a material that reduces the possibility of inadvertent movement of the handle in a user's hand. For example, suitable materials include rubber or soft plastic that may be shaped as desired. Alternatively, the handle may also be configured as a hand piece similar to those found in handguns, or even be configured as the end of a rifle. The stopper is preferably a ring that is fixedly coupled (as integral part or as added, optionally removable part) to the guide element in a predetermined position to avoid loss of the base as the base moves along the guide element. Thus, the stopper may have numerous shapes other than those shown in the Figures so long as those shapes will stop movement of the base beyond the position of the stopper. Where desired, the stopper may also be integral with the guide element and have a larger diameter, or otherwise prevent the base from moving beyond the stopper. For example, suitable stoppers may only partially surround the guide element, or may even only be protruding elements (e.g., pins, bolts, etc.). With respect to the materials, it should be noted that the suitable stopper material is largely dependent on economic and design considerations. Thus, preferred materials will typically include synthetic polymers, and most preferably foam blocks. Additional elements may be included to the stopper to enhance player attraction, including a sight, light- and/or sound-producing elements, etc.

It should also be appreciated that the resilient elements are most preferably commercially available circular rubber bands well known in the art. Such bands may be easily obtained at low cost and be replaced by an even only moderately dexterous person. Typically, the rubber bands are coupled to the launcher such that one portion will engage with the base (e.g., in cutouts, or by threading around at least part of the base) while the other portion will be retained in or on the guide element (or other dedicated portion that is integral or coupled to the guide element). Most preferably, the upper end of the guide element has a plurality of cutouts that receive a portion of the resilient element as depicted in the Figures. Alternatively, the resilient element may be retained by press fit (or other manner of engagement) and/or with a cap that is disposed on top of the guide element. Such cap (threaded or press fit) may then advantageously act as a stopper as well. Suitable alternative resilient elements may be linear rubber bands, springs, and all other materials that provide sufficient kinetic energy to the flying toy.

Consequently, a launcher for a flying cylinder includes an elongate guide element having a first end and a second end, and a base that is movably coupled to the guide element such that the base is movable along a longitudinal axis of the guide element. Most typically, the first end is configured to removably receive a first portion of a resilient element such that the first portion of the resilient element is retained by a wall of the guide element, and the base is configured to removably receive a second portion of the resilient element such that the second portion of the resilient element is retained by an indentation in the base. In such launchers, the base is further configured to at least partially surround the guide element and to support at least a portion of a flying cylinder, and a stopper is coupled to the first end and configured such that the stopper stops movement of the base past the first end. It should be particularly noted that the term "launcher" as used herein is expressly limited to launchers for flying toys and specifically excludes launchers for military or hunting hardware (e.g., grenades, spears, arrows, bullets, etc.). Thus, while preferred launchers will be used to launch flying cylinders, it should be appreciated that rockets, gliders, and other flying toys may also be propelled from the launcher. Most typically, the flying toy in such uses will be configured such that a cylindrical portion of the toy circumferentially encloses the elongate guide element (e.g., rocket body, or glider fuselage), or the base may be configured to receive and temporarily retain the flying toy.

In operation, a user will place a flying cylinder onto the base of the launcher and hold the launcher on the handle in one hand while retracting the base along the guide element with the other hand, typically using the grip. A relative rotational movement of the handle/guide element and the base will tension the resilient elements such that, when the base is released, the base will move along the guide element in a forward and rotational motion and thereby propel the flying cylinder in the same manner. Previous experiments using the Xzylo Flyer have shown that the launcher can propel the flying cylinder reproducibly over a distance of several hundred feet (typically between 100-300 yards).

As the resilient elements will typically deteriorate or break at some point, or as a user may add further resilient elements or exchange current elements with stronger resilient elements, the user will also be instructed with replacement instructions. Consequently, a method of instructing a user of a launcher of a flying cylinder (the launcher having an elongate guide element with a first end and a second end, further having a base movably coupled to the guide element such that the base is movable along a longitudinal axis of the guide element, wherein the base is further configured to at least partially surround the guide element and to support at least a portion of a flying cylinder) will include the steps of (1) instructing the user to insert a first portion of a resilient element into the first end such that the first portion of the resilient element is retained by a wall of the guide element, (2) instructing the user to insert a second portion of the resilient element into the base such that the second portion of the resilient element is retained by an indentation in the base, and (3) optionally instructing the user to couple a stopper to the first end and such that the stopper stops movement of the base past the first end.

Thus, specific embodiments and applications of launchers for flying cylinders have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A launcher for a flying cylinder, comprising:

an elongate guide element having a first end and a second end, and a base that is movably coupled to the guide element such that the base is movable along a longitudinal axis of the guide element;

wherein the first end is configured to removably receive in a receiving structure a first portion of a resilient element such that the first portion of the resilient element is retained by a wall of the guide element;

wherein the base is configured to removably receive a second portion of the resilient element, optionally such that the second portion of the resilient element is retained by an indentation in the base;

wherein the base is further configured to at least partially surround the guide element and to support at least a portion of a flying cylinder;

a grip having a cylindrical portion that is coaxially and slidably coupled to the elongate guide element and further coupled to the base such that the base and the grip move together;

a stopper coupled to the first end and configured such that the stopper stops movement of the base past the first end; and wherein the stopper is coupled to the guide element in a position between the receiving structure and the second end.

2. The launcher of claim 1 wherein the grip and the base are configured to allow rotation of the base around the longitudinal axis when the grip is rotated.

3. The launcher of claim 1 wherein the first end is integral with the elongate guide element.

4. The launcher of claim 1 wherein the first end is integral with the stopper.

5. The launcher of claim 1 wherein the second end is configured as a cylindrical handle.

6. The launcher of claim 1 wherein the resilient element is a circular rubber band, and wherein the launcher optionally includes a second circular rubber band.

7. The launcher of claim 1 wherein the indentation is a cutout in the base configured to snugly receive the first portion of the resilient element.

8. A method of instructing a user of a launcher of a flying cylinder, comprising:

providing a launcher according to claim 1;

instructing the user to insert the first portion of the resilient element into at least one of the plurality of cutouts such that the first portion of the resilient element is secured to the guide element by at least one of (a) a press fit of the resilient element into the cutout in the guide element, and (b) a cap that is removably coupled to the first end and configured to retain the resilient element, wherein the cap is optionally threaded;

instructing the user to insert the second portion of the resilient element into the base, optionally such that the second portion of the resilient element is retained by an indentation in the base.

9. The method of claim 8 wherein the resilient element is a rubber band.

10. The method of claim 8 wherein the cap is configured as a stopper.

11. The method of claim 8 wherein the step of instructing the user to insert the second portion of the resilient element comprises an instruction to insert the second portion into a cutout of the base.

12. The method of claim 8 further comprising a step of instructing the user to couple a second resilient element to the first end and the base.

13. The method of claim 8 wherein the stopper is integral with the first end.

14. The method of claim 8 further comprising a step of instructing the user to insert the elongate guide element through an opening in the base.

15. A launcher comprising:

an elongate guide element having a first end and a second end, and a base with a grip, wherein the base and the grip are movably coupled to the guide element such that the base and grip are movable along and rotatable about a longitudinal axis of the guide element;

wherein the grip has a cylindrical portion that is coaxially and slidably coupled to the elongate guide element;

wherein the first end has a plurality of cutouts in the guide element that are configured to removably receive a first portion of a resilient element such that the first portion of the resilient element is received in the cutouts;

wherein the base is configured to removably receive a second portion of the resilient element;

wherein the base is further configured to at least partially surround the guide element and to support at least a portion of a flying cylinder; and a stopper coupled to the first end and configured such that the stopper stops movement of the base past the first end.

* * * * *